US006196033B1

(12) United States Patent
Dowdle

(10) Patent No.: US 6,196,033 B1
(45) Date of Patent: Mar. 6, 2001

(54) RESTRAINING DEVICE EMPLOYING BUNDLING TIES

(76) Inventor: Christopher A. Dowdle, 25634 Bejoal St., Barstow, CA (US) 92311-3418

( * ) Notice: Subject to any disclaimer, the term of this patent is extended or adjusted under 35 U.S.C. 154(b) by 0 days.

(21) Appl. No.: 09/383,075

(22) Filed: Aug. 26, 1999

(51) Int. Cl.[7] ..... E05B 75/00
(52) U.S. Cl. ..... 70/16; 24/16 PB
(58) Field of Search ..... 70/14–17; 24/16 PB

(56) References Cited

U.S. PATENT DOCUMENTS 4,024,736 * 5/1977 De Michieli ..... 70/16
4,071,023 * 1/1978 Gregory ..... 70/16 X
4,909,051 * 3/1990 Lee ..... 70/16
5,193,254 * 3/1993 Geisinger ..... 70/16 X
5,377,388 * 1/1995 DeBever ..... 24/16 PB
5,398,383 * 3/1995 Bingold ..... 70/16 X
5,551,086 * 9/1996 Albanese ..... 70/16 X
5,802,675 * 9/1998 Parsons ..... 70/16 X

* cited by examiner

*Primary Examiner*—Suzanne Dino Barrett
(74) *Attorney, Agent, or Firm*—Siemens Patent Services LC

(57) ABSTRACT

Keyless restraints similar to handcuffs and leg shackles, which restraints employ conventional ratchet action bundling ties. The restraints include a securing block which has two receptacle each capable of receiving the pawl block of one bundling tie. After the pawl block of each bundling tie is placed in its respective receptacle, the toothed strap of each bundling tie is inserted through aligned slots formed in opposing sides of its associated receptacle. The toothed strap engages the pawl block by conventional ratchet action. The bundling ties are then entrapped within the securing block, and can be drawn around the wrists of a detainee or any other object being secured. Each receptacle has a projection which releasably retains the pawl block of the bundling tie in place within the receptacle. Optionally, the receptacles are connected by a flexible tether long enough to permit a detainee to walk, but too short to permit running.

5 Claims, 2 Drawing Sheets

RESTRAINING DEVICE EMPLOYING BUNDLING TIES

REFERENCE TO RELATED APPLICATION

This application is related to Ser. No. 09/186,481, filed Nov. 5, 1998 and now abandoned.

BACKGROUND OF THE INVENTION

1. Field of the Invention

The present invention relates to keyless restraints such as hand cuffs. More particularly, the invention sets forth a restraining device which employs ordinary bundling ties in combination with a securing block to form a keyless restraint. The invention finds its principal application in the field of law enforcement, wherein police and others charged with detaining suspects and prisoners must restrain the same.

2. Description of the Prior Art

When police and others authorized detain and restrain persons taken into custody, they usually employ conventional hand cuffs and leg shackles. These conventional restraint devices are usually fabricated from metals and require key operated locks to release the restrainee. In order to reduce cost, complexity, and ease of operation, the prior art has suggested keyless restraints based on ratchet action bundling ties modified to be usable as restraints.

Examples are seen in U.S. Pat. No. 4,910,831, issued to Richard F. Bingold on Mar. 27, 1990, U.S. Pat. No. 4,964,419, issued to Roy L. Karriker on Oct. 23, 1990, U.S. Pat. No. 5,088,158, issued to Gary D. Burkholder on Feb. 18, 1992, U.S. Pat. No. 5,443,155, issued to Edwin Robinson on Aug. 22, 1995, and U.S. Pat. Nos. 5,669,110 and 5,802,888, issued to Kevin L. Parsons respectively on Sep. 23, 1997, and Sep. 8, 1998. In each example, the subject device requires special configuration of the cables to succeed. By contrast, the present invention successfully utilizes inexpensive, readily available conventional industrial or commercial bundling ties. None of the prior art devices employs the securing block of the present invention which securing block enables conventional bundling ties to be utilized.

None of the above inventions and patents, taken either singly or in combination, is seen to describe the instant invention as claimed.

SUMMARY OF THE INVENTION

The present invention sets forth a securing block having openings dimensioned and configured to receive two conventional bundling ties to form restraints such as keyless handcuffs and leg shackles for low and medium security applications, such as temporary detention and transport between legal facilities. Of course, the restraints can be employed in other settings, such as by farmers and hunters who must immobilize and transport animals, or to establish a suitable hand hold for carrying animal carcasses. In still other examples, the restraints can be employed to join posts together to form the skeleton of a structure, such as a tent, free standing corral, sections of fence, and the like.

Internal openings formed in the securing block serve two functions. One is to hold the bundling ties, once drawn tight, in suitable positions such that the resultant device serves as a restraint. A second function is that of enabling the ties to be drawn to desired tightness employing ratchet action conventionally practiced with bundling ties.

A bundling tie is held captive within the securing block after being passed through an entry slot of the securing block, the pawl block of the bundling tie, and an egress slot of the securing block. The cavity of the securing block has projections which retain the pawl block of the bundling tie in place within the securing block before the toothed section of the bundling tie engages the pawl. Once the bundling tie is cut, the pawl block is easily removed from the securing block, which can then be reused when desired by uncomplicated insertion of a new bundling tie.

A significant advantage of this invention is that conventional bundling ties may be employed. Complicated, expensive configurations of the prior art keyless restraints are substantially avoided. This feature greatly reduces production and acquisition costs, and makes procurement of replacement ties easy and inexpensive.

The novel restraint is quickly and easily assembled by drawing conventional bundling ties through the securing block, wherein they will oppose release by ratchet action. Restraints can thus be assembled or installed without keys, tools and other hardware. Conventional bundling ties are inexpensive and easily cut to release the detainee once he or she has arrived at a destination. The securing blocks can be readily reused with new bundling ties. Therefore, unlike most prior art keyless restraints, the most expensive component of the restraint is readily reused almost indefinitely.

In an alternative embodiment of the invention, two securing blocks are provided, each tethered to yet spaced apart from the other. The tether is flexible. This alternative embodiment serves as leg shackles which allow a person to walk but not to extend the stride as one would do when running.

Accordingly, it is a principal object of the invention to provide keyless restraints which employ conventional bundling ties.

It is another object of the invention to provide convenient apparatus for joining posts together to build structures.

It is a further object of the invention to provide keyless restraints which are readily assembled and released.

Still another object of the invention is to provide keyless restraints which are inexpensive.

Yet another object of the invention is to secure the pawl block of a bundling tie within the securing block of the restraint before the toothed section of the tie engages the pawl of the restraint.

An additional object of the invention is to enable ready removal of a spent bundling tie once it is cut, so that the securing block is readily reusable.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
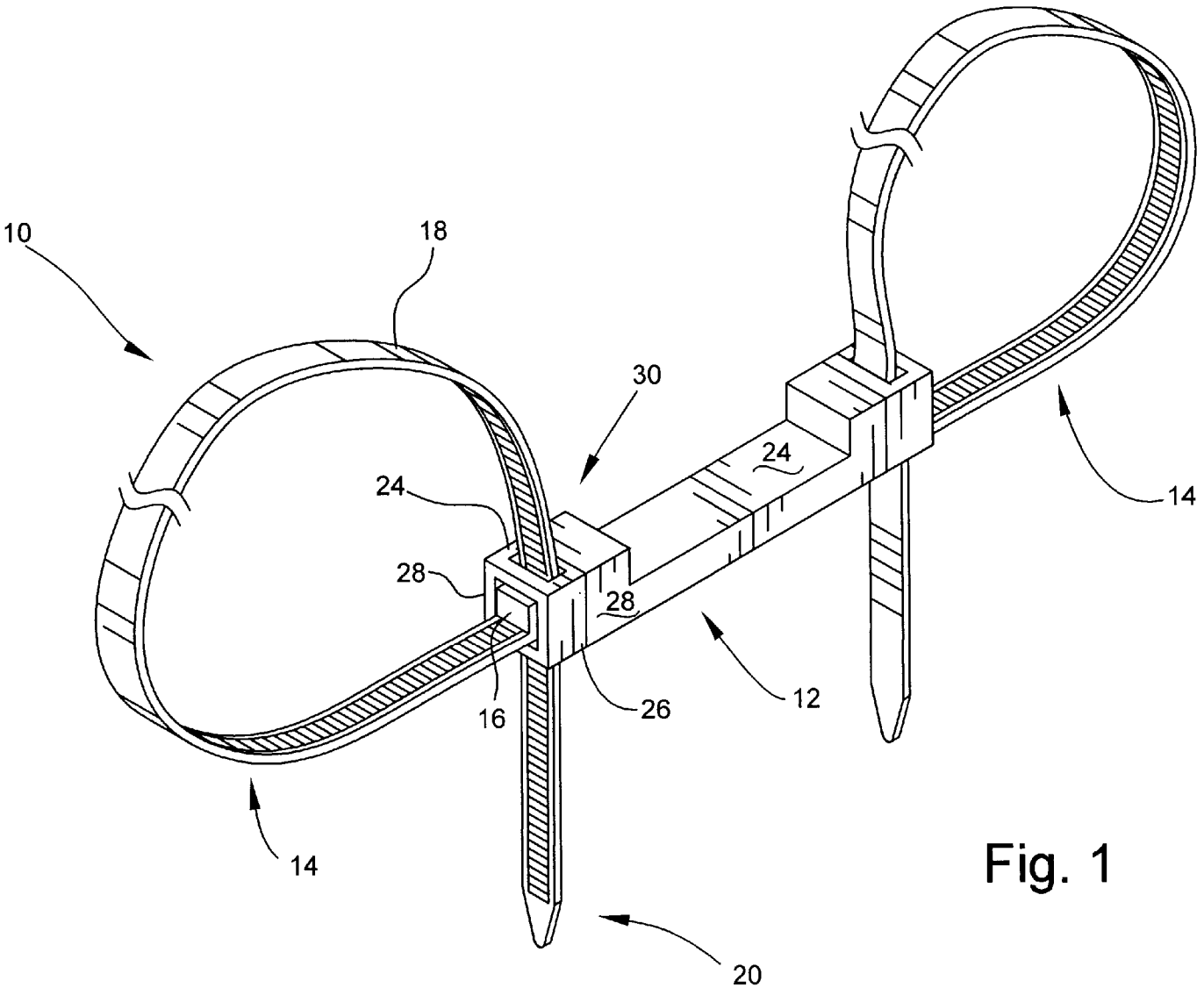
FIG. 1 is a perspective view of the invention.

Turning now to FIG. 1 of the drawings, keyless restraint 10 is shown in its assembled condition. Restraint 10 includes a securing block 12 and two bundling ties 14. Bundling ties 14 are conventional in nature, each having a pawl block 16 and a toothed strap 18 connected to pawl block 16. For the purposes of restraining human detainees, bundling ties are selected to have appropriate length. Conventional ties are fabricated from, for example, nylon, and have tensile strength on the order of three hundred pounds. Strap 18 is bent around as shown so that its free end 20 can be passed through pawl block 16 and engaged to oppose withdrawal of strap 18 from pawl block 16. Construction of pawl block 16 to accomplish this is well known and will not be set forth in greater detail herein.

Securing block 12 receives bundling ties 14 as shown, such that each bundling tie 14 is entrapped by interengagement with securing block when assembled to form a closed loop, with free ends 20 projecting below securing block 14. A detainee's hands (the detainee is not shown) are passed through each loop, and free ends 20 are drawn downwardly, as depicted in FIG. 1, so that the loop constricts over the wrists until escape from restraint 10 is not feasible.

Figure 2:
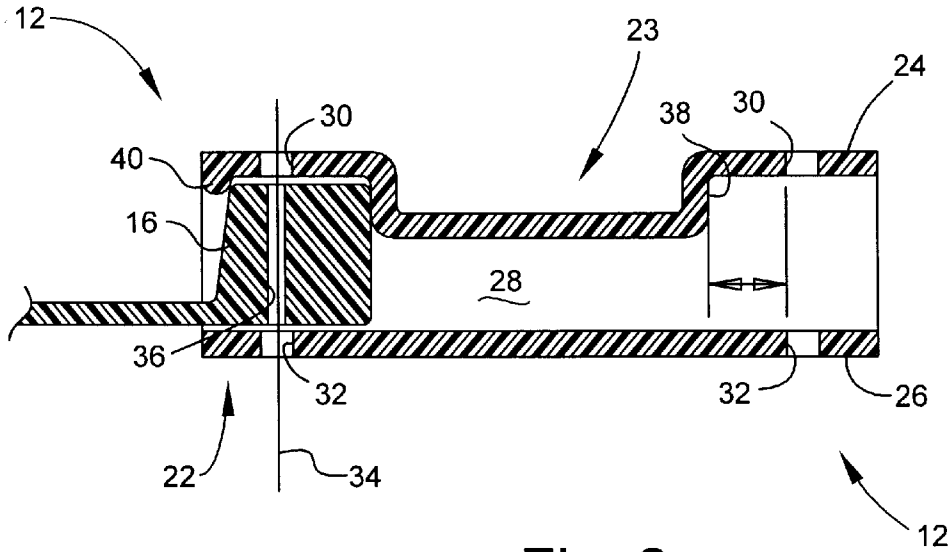
FIG. 2 is a diagrammatic, cross sectional detail view of the invention.

Referring now to FIG. 2, securing block 12 has first and second receptacles 22 each for receiving one pawl block 16 of a bundling tie 14. A bridge 23 spans and rigidly connects receptacles 22, 22, holding receptacles 22 in spaced apart relation. Receptacles 22 are preferably formed as mirror images of one another, although this is not critical to the invention. In the preferred embodiment, receptacles 22 open in opposed directions, although this orientation is not critical.

Each receptacle 22 is dimensioned and configured to receive one pawl block 16 of one bundling tie 14. One receptacle 22 will be described herein, it being understood that the other receptacle 22 is structurally and functionally similar. Receptacle 22 has a lateral wall defining and partially enclosing a chamber therein for receiving one pawl block 16 therein. The lateral wall includes an upper wall 24, a lower wall 26, and connecting walls 28 (all walls of one receptacle 22 are clearly shown in FIG. 3).

Upper wall 24 has a first slot 30 passing entirely therethrough. Lower wall 26 has a corresponding second slot 32 passing entirely therethrough in direct alignment with first slot 30. Projection line 34 shows that not only are slots 30 and 32 aligned, but that strap passageway 36 of pawl block 16 is aligned with slots 30, 32. This relationship assures that free end 20 of strap 18 can pass readily through both securing block 12 and also pawl block 16 of a bundling tie 14 when strap 18 is inserted into slot 30 of a receptacle 22, through pawl block 16 of bundling tie 14 when pawl block 16 is fully inserted into receptacle 22, and through slot 32 of the receptacle 22.

Appropriate alignment of slots 30, 32 with strap passageway 36 of pawl block 16 is assured by the following feature. Each receptacle 22 includes a stop in the form of shoulder 38 which limits insertion of its associated pawl block 16 into that receptacle 22. Pawl blocks 16 are spaced apart from one another when fully inserted into their respective receptacles 22 so each does not to interfere with installation of the other, and so that limitation of insertion each pawl block 16 is not dependent upon presence of the other pawl block 16 in the hollow channel of securing block 12.

Pawl block 16 is entrapped within receptacle 22 by projections 40. Projections 40 project into receptacle 22 only enough to close resiliently over pawl block 16 when pawl block 16 is fully inserted into receptacle 22. Pawl block 16 can be manually removed from receptacle 22 by resiliently displacing projections 40 by manual effort.

Figure 3:
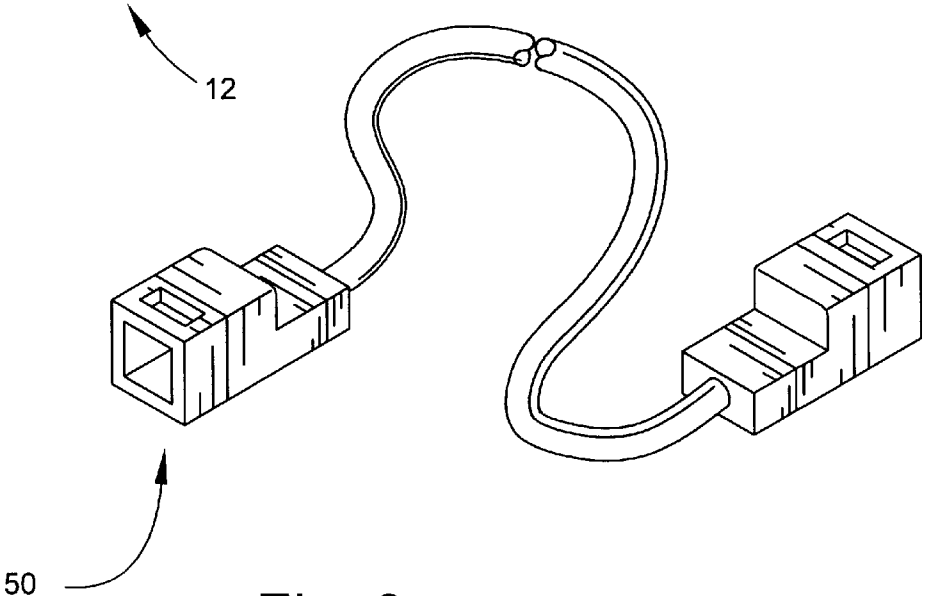
FIG. 3 is a perspective detail view of an alternative embodiment of the invention.

FIG. 3 illustrates a second embodiment of the invention wherein keyless restraint 50 may be employed as leg shackles which enable a person (not shown) wearing keyless restraint 50 to walk, while preventing the person from running. In restraint 50, receptacles 52 are connected by a bridge 54 which is elongate and flexible. Elongate signifies that bridge 54 is of length at least of a magnitude greater than the combined lengths of receptacles 52. Other than with respect to connection to bridge 54, receptacles 52 are similar to receptacles 22 of the embodiment of FIG. 1.

It is to be understood that the present invention is not limited to the embodiments described above, but encompasses any and all embodiments within the scope of the following claims.

What is claimed is:

1. A keyless restraint, comprising:

a securing block for receiving bundling ties, comprising a housing having a first receptacle, a second receptacle, and a bridge connecting said first receptacle and said second receptacle; and a first bundling tie having a pawl block and a toothed strap attached to said pawl block of said first bundling tie, and a second bundling tie having a pawl block and a toothed strap attached to said pawl block of said second bundling tie, wherein said first receptacle is dimensioned and configured to receive said pawl block of said first bundling tie, and has a first slot and a second slot disposed such that said toothed strap of said first bundling tie may be inserted into said first slot of said first receptacle, through said pawl block of said first bundling tie, and through said second slot of said first receptacle, and said first bundling tie is entrapped by interengagement with said securing block, and wherein said second receptacle is dimensioned and configured to receive said pawl block of said second bundling tie, and has a first slot and a second slot disposed such that said toothed strap of said second bundling tie may be inserted into said first slot of said second receptacle, through said pawl block of said second bundling tie, and through said second slot of said second receptacle, and said second bundling tie is entrapped by interengagement with said securing block, wherein said securing block further comprises a shoulder formed in said securing block in a location which limits insertion of said first pawl block into said first receptacle, and a second shoulder formed in said securing block in a location which limits insertion of said second pawl block into said second receptacle, such that said first pawl block and said second pawl block are spaced apart from one another when fully inserted respectively into said first receptacle and said second receptacle.

2. The keyless restraint according to claim 1, wherein said bridge is elongate and flexible, whereby said keyless restraint may be employed as leg shackles which enable a person wearing said keyless restraint to walk while preventing the person wearing said keyless restraint from running.

3. A keyless restraint, comprising:

a securing block for receiving bundling ties, comprising a housing having a first receptacle, a second receptacle, and a bridge connecting said first receptacle and said second receptacle; and a first bundling tie having a pawl block and a toothed strap attached to said pawl block of said first bundling tie, and a second bundling tie having a pawl block and a toothed strap attached to said pawl block of said second bundling tie, wherein said first receptacle is dimensioned and configured to receive said pawl block of said first bundling tie, and has a first slot and a second slot disposed such that said toothed strap of said first bundling tie may be inserted into said first slot of said first receptacle, through said pawl block of said first bundling tie, and through said second slot of said first receptacle, and said first bundling tie is entrapped by interengagement with said securing block, and wherein said second receptacle is dimensioned and configured to receive said pawl block of said second bundling tie, and has a first slot and a second slot disposed such that said toothed strap of said second bundling tie may be inserted into said first slot of said second receptacle, through said pawl block of said second bundling tie, and through said second slot of said second receptacle, and said second bundling tie is entrapped by interengagement with said securing block, wherein said first receptacle and said second receptacle each have a short projection projecting thereinto, and wherein said housing is sufficiently resilient such that each of said projections are resiliently displaced when said pawl block of said bundling tie is inserted into said receptacle, and said projection is located within said receptacle such that said projection entraps said pawl block within said receptacle when said pawl block is fully inserted into said receptacle.

4. A securing block for a keyless restraint employing conventional bundling ties, comprising a housing having a first receptacle for receiving the pawl block of a bundling tie, a second receptacle for receiving the pawl block of a bundling tie, and a bridge connecting said first receptacle and said second receptacle in spaced apart relation, wherein said first receptacle and said second receptacle each comprise a lateral wall defining and partially enclosing a rectangular chamber therein, said lateral wall having a first slot and an opposed second slot disposed to receive and pass the toothed strap of a bundling tie into and through said receptacle, and a member interfering with and limiting insertion of a pawl block into said receptacle beyond a predetermined distance assuring that said first slot and said second slot align with the slot of the pawl block of the bundling tie when the pawl block of the bundling tie is fully inserted into said receptacle, wherein said first receptacle and said second receptacle each have a short projection projecting thereinto, and wherein said housing is sufficiently resilient such that each of said projections are resiliently displaced when said pawl block of said bundling tie is inserted into said receptacle, and said projection is located within said receptacle such that said projection entraps said pawl block within said receptacle when said pawl block is fully inserted into said receptacle.

5. The securing block according to claim 4, wherein said first receptacle and said second receptacle each have length, and said bridge has length greater than the combined lengths of said first receptacle and said second receptacle, and wherein said bridge is flexible.

* * * * *